US006648323B2

(12) United States Patent
Hsieh

(10) Patent No.: US 6,648,323 B2
(45) Date of Patent: Nov. 18, 2003

(54) FEEDING DEVICE

(75) Inventor: Yen-Sung Hsieh, Taipei (TW)

(73) Assignee: BenQ Corporation, Taoyuan (TW)

( * ) Notice: Subject to any disclaimer, the term of this patent is extended or adjusted under 35 U.S.C. 154(b) by 0 days.

(21) Appl. No.: 09/905,788

(22) Filed: Jul. 13, 2001

(65) Prior Publication Data

US 2002/0079639 A1 Jun. 27, 2002

(30) Foreign Application Priority Data

Dec. 21, 2000 (TW) ..... 89127524 A

(51) Int. Cl.[7] ..... B65H 1/08
(52) U.S. Cl. ..... 271/126; 271/147; 271/160
(58) Field of Search ..... 221/231, 56, 279; 271/109, 126, 127, 245, 241, 147, 160, 148

(56) References Cited

U.S. PATENT DOCUMENTS

| | | | | | |
|---|---|---|---|---|---|
| 1,130,109 | A | * | 3/1915 | Rolier | 271/160 |
| 3,749,281 | A | * | 7/1973 | Stovers et al. | 221/279 |
| 4,007,925 | A | * | 2/1977 | DeRyke et al. | 271/126 |
| 4,216,953 | A | | 8/1980 | Varady et al. | 271/11 |
| 4,319,741 | A | * | 3/1982 | Okamoto | 271/127 |
| 5,026,041 | A | * | 6/1991 | Kitazume et al. | 271/127 |
| 5,634,188 | A | * | 5/1997 | Johnston et al. | 271/127 |
| 6,199,855 | B1 | * | 3/2001 | Choeng et al. | 271/245 |

FOREIGN PATENT DOCUMENTS

| | | | | |
|---|---|---|---|---|
| DE | 10 88 510 | | 9/1960 | |
| DE | 29 39 342 | | 7/1980 | |
| JP | 0156929 | * | 9/1982 | 271/126 |
| JP | 0002941 | * | 1/1989 | 271/127 |
| JP | 405319587 A | * | 12/1993 | 271/126 |

* cited by examiner

*Primary Examiner*—David H. Bollinger
(74) *Attorney, Agent, or Firm*—Ladas & Parry

(57) ABSTRACT

A printer comprises a feeding device and a printing device. The feeding device has a substrate, a linkage mechanism, a deskewer, a recovery device and a scrubber. The linkage mechanism is disposed on the substrate and has a pallet used to support the media and moving between an initial site and a predetermined site in parallel. The deskewer is used for deskewing the media located on the pallet, the recovery device is disposed on the linkage mechanism, and the scrubber for feeding the media located on the pallet toward the printing device. Once the media is placed between the pallet and the scrubber or gradually delivered to the printing device by the scrubber, the pallet of the linkage mechanism is downwardly or upwardly shifted in parallel by the compressed recovery device.

33 Claims, 4 Drawing Sheets

FEEDING DEVICE

BACKGROUND OF THE INVENTION

1. Field of the Invention

This invention relates to a feeding device. More particularly, this invention relates to a feeding device with a linkage mechanism for supporting media and a recovery device for returning to its original position.

2. Description of Prior Art

FIG. 1A is a plan view showing a feeding structure P0 according to the prior art. The feeding structure P0 comprises a holding pressure pallet 101 pivoted on a pivot shaft 102, a pick feed roller 104 and a deskewer 105. The pallet 101 is used to support a full load of media 103 such as sheet of paper. The roller 104 is provided with a scrubbing surface 104A to transmit the media 103 to a printing device (not shown), and the deskewer 105 is used to deskew the media 103 located on the pallet 101. Symbol "C1" represents the point of the roller 104 contacting the top sheet of media 103, and Symbol "a1" represents the distance measured between the point C1 and the deskewer 105.

FIG. 1B is a plan view showing another deployment of feeding structure P0 according to FIG. 1A, in which a half load of media 103 remains. Symbol "C2" represents the point of the roller 104 contacting the top sheet of media 103, and Symbol "a2" represents the distance measured between the point C2 and the deskewer 105.

FIG. 1C is a plan view showing another deployment of the feeding structure P0 according to FIG. 1A, in which only a few sheets of media 103 remain. Symbol "C3" represents the point of the roller 104 contacting the top one of the media 103, and Symbol "a3" represents the distance measured between the point C3 and the deskewer 105.

In comparison with FIG. 1A, 1B and 1C, the distance (a1, a2, a3) between the contacting point (C1, C2, C3) of the feeding structure P0 is gradually decreased while the media 103 located on the pallet 101 are gradually removed by the roller 104. That is to say, the relationship among the distances a1, a2, a3 is a1>a2>a3.

The media 103 cannot be smoothly removed by the scrubbing surface 104A of the roller 104 when the distance between the contacting point and the deskewer 105 is reduced, which also causes other problems such as paper jamming, sticking, and distorting during the feeding process. Although the above problems can be solved by enlarging the size of the roller 104 or the distance between the pivot shaft 102 and the roller 104, the total volume and production costs of the feeding structure P0 are increased commensurately.

SUMMARY OF THE INVENTION

The primary object of this invention is to provide a feeding structure for transmitting media to a printing device. The feeding device has a substrate, a linkage mechanism, a deskewer, a recovery device and a scrubber. The linkage mechanism is disposed on the substrate and has a pallet used to support the media and move between an initial site and a predetermined site in parallel. The deskewer is used for deskewing the media located on the pallet and the recovery device is disposed on the linkage mechanism, and the scrubber for feeding the media located on the pallet toward the printing device.

Once the media is placed between the pallet and the scrubber or gradually delivered to the printing device by the scrubber, the pallet of the linkage mechanism can be downwardly or upwardly shifted in parallel by the compressed recovery device.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

First Embodiment

Figure 1A:
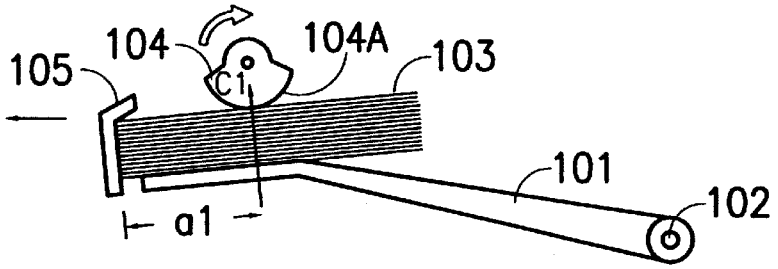
FIG. 1A ( PRIOR ART )
FIG. 1A is a plan view showing a feeding structure (P0) according to the prior art, comprising a pallet (101) for supporting a full load of media (103)
Figure 1B:
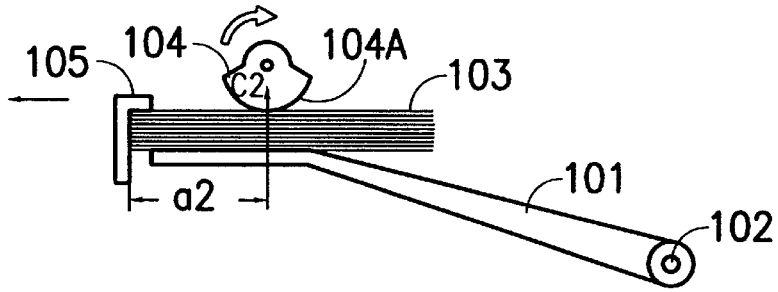
FIG. 1B ( PRIOR ART )
FIG. 1B is a plan view showing another deployment of the feeding structure (P0) according to FIG. 1A, in which a half load of media (103) remains.
Figure 1C:
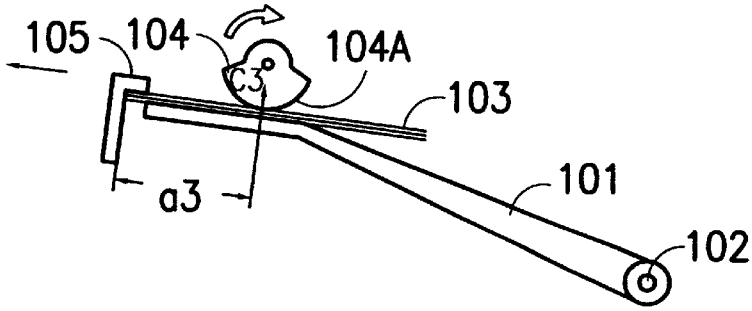
FIG. 1C ( PRIOR ART )
FIG. 1C is a plan view showing another deployment of feeding structure (P0) according to FIG. 1A, in which only a few sheets of media (103) remain.
Figure 2A:
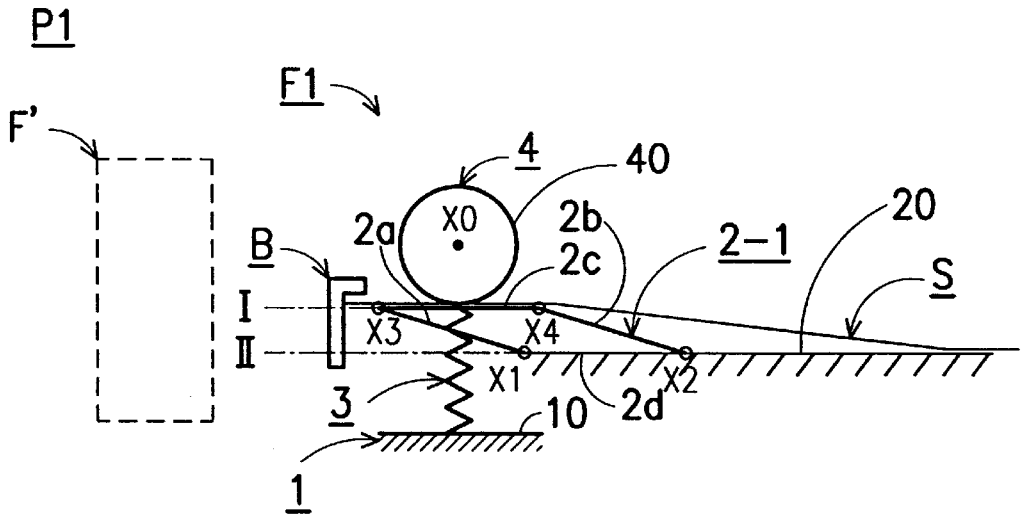
FIGS. 2A, 2B and 2C are three plan views showing different deployments of a feeding device (F1) of a printer (P1) according to a first embodiment of the present invention.
Figure 2B:
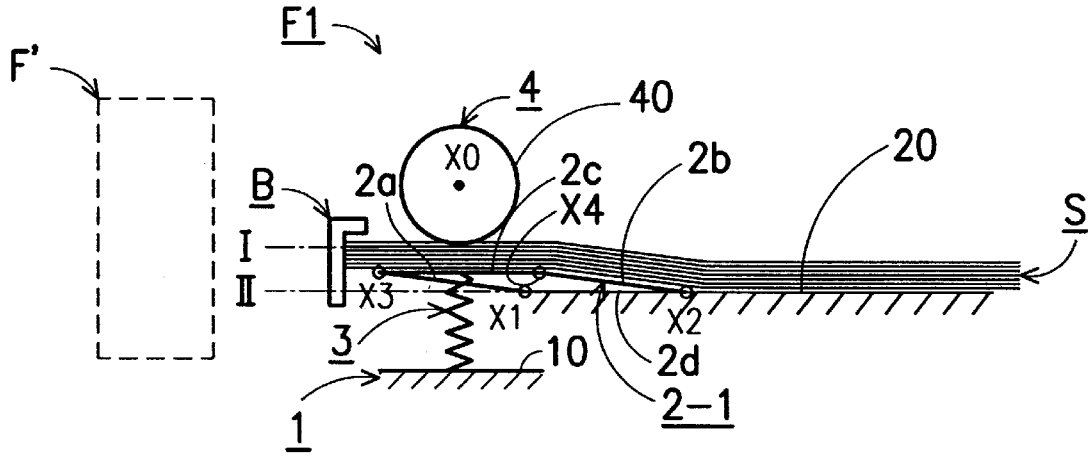
Figure 2C:
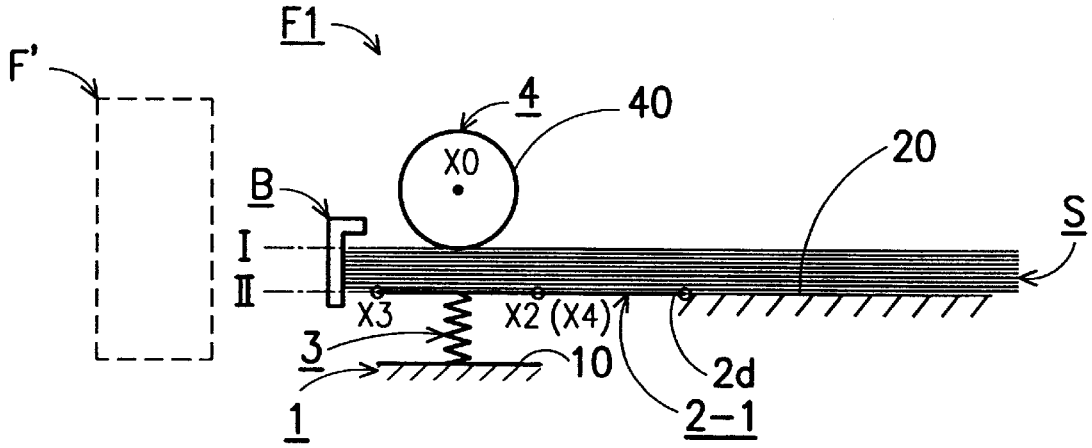

FIG. 2A is a plan view showing a feeding device F1 according to the present invention, wherein only one sheet of media S is present. FIG. 2B is a plan view showing a half load of media S being supported by the linkage assembly 2-1 according to FIG. 2A. FIG. 2C is a plan view showing a full load of media S being supported by the linkage assembly 2-1 according to FIG. 2A.

In FIG. 2A, a feeding device F1 and a printing device F' are two major parts of a printer P1. The feeding device F1 comprises a substrate 1, a recovery device 3, a scrubber 4, a linkage mechanism 2-1 and a deskewer B. Media S such as papers are supported by the linkage mechanism 2-1 and delivered to a printing device F' by the scrubber 4.

The substrate 1 has a first surface 10 and a second surface 20, wherein the linkage mechanism 2-1 is disposed on the second surface 20, and the recovery device 3 is disposed between the linkage mechanism 2-1 and the first surface 10. In this embodiment, the recovery device 3 is a resilient device such as spring.

The linkage mechanism 2-1 is a four-portion linkage comprising a first portion 2*a*, a second portion 2*b*, a third portion 2*c* and a fourth portion 2*d*. The fourth portion 2*d* is a fixed portion for the base of the linkage mechanism 2-1, and the substrate 1 can be considered as the fourth portion 2*d*. The first portion 2*a* and the second portion 2*b* are two oscillating arms with the same size, which are mounted on the first surface 10 with a hinge X1 and a hinge X2, respectively. The third portion 2*c* is connected to the first portion 2*a* and the second portion 2*b* with a hinge X3 and a hinge X4, respectively. The third portion 2*c* is used as a pallet for supporting the media S and moved between an initial site I and a predetermined site II in parallel. The recovery device 3 is disposed between the third portion 2*c* and the first surface 10, and one end of the recovery device 3 is pressed against the third portion 2*c*.

The deskewer B is a plate disposed next to the linkage mechanism 2-1 so as to deskew the media P located on the third portion 2*c*. The scrubber 4 is a picking roller rotated about an axis X0 and provided with a scrubbing surface 40 contacting the media S located on the third portion 2*c* of the linkage mechanism 2-1. Once the scrubber 4 is actuated, the scrubbing surface 40 of the scrubber 4 presses on the media P located on the third portion 2*c* and passes it sequentially to the printing device F'.

In FIG. 2B, by adding a half load of the media S on the linkage mechanism 2-1, the third portion 2*c* is downwardly shifted from the initial site I toward the predetermined site II with the thickness of the media S. The first portion 2*a* and the second portion 2*b* are synchronously rotated in a counterclockwise direction, and the shifting third portion 2*c* presses the recovery device 3. The compressed recovery device 3 pushes the third portion 2*c* upward and provides sufficient normal force to generate friction between the scrubber 4 and the media S.

In FIG. 2C, the third portion 2*c* is shifted to the predetermined site II and the first portion 2*a* and the second portion 2*b* are located almost parallel to the second surface 20 when a full load of the media S is added as shown.

On the contrary, the third portion 2*c* is upwardly shifted from the predetermined site II toward the initial site I when the media S are gradually transmitted to the printing device F' by the scrubber 4.

Second Embodiment

Figure 3A:
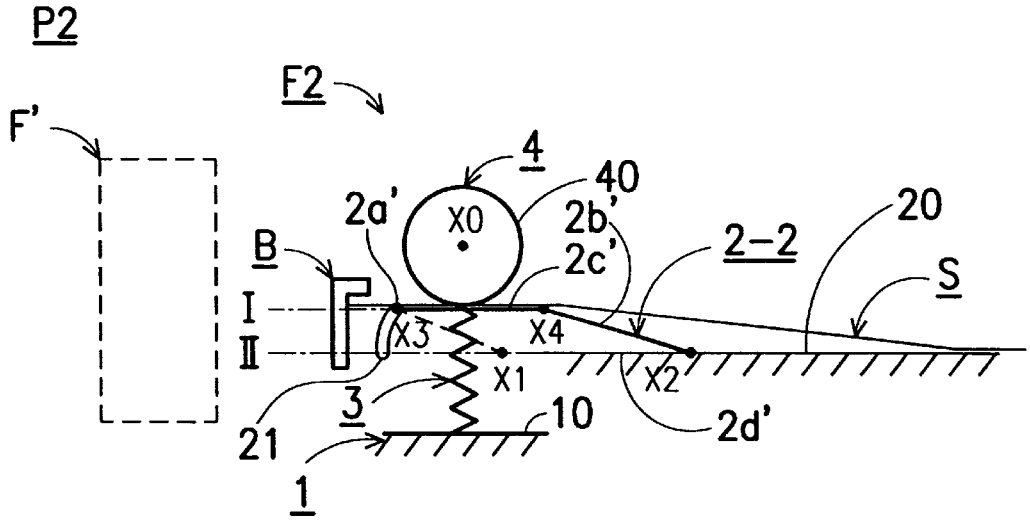
FIGS. 3A, 3B and 3C are three plan views showing different deployments of a feeding device (F2) of a printer (P2) according to a second embodiment of the present invention.
Figure 3B:
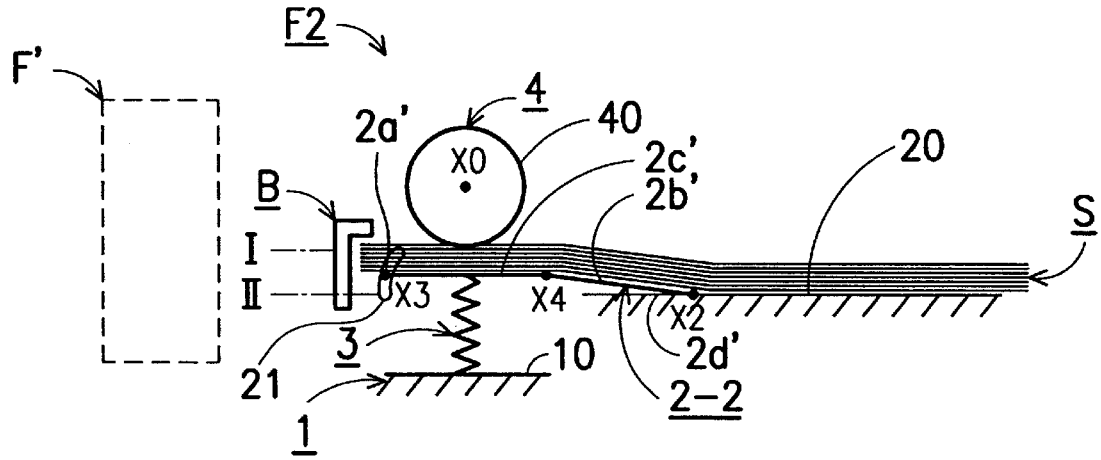
Figure 3C:
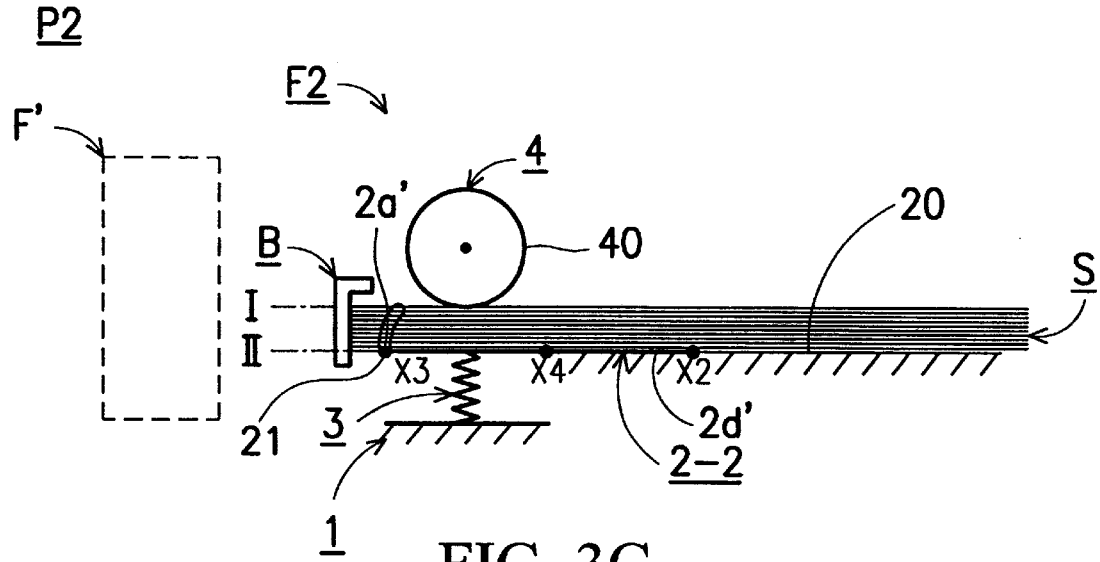

FIG. 3A is a plan view showing a feeding device F2 according to the present invention, wherein only one sheet of the media S is supported. FIG. 3B is a plan view showing a half load of media S being supported by the linkage assembly 2—2 according to FIG. 3A. FIG. 3C is a plan view showing a full load of media S being supported by the linkage assembly 2—2 according to FIG. 3A.

The feeding device F2 differs from the feeding device F1 in that the linkage mechanism 2—1 mentioned in the first embodiment is replaced with a linkage mechanism 2—2, which is also a four-portion linkage but simplified into a sliding block linkage. The same elements with the same functions that are already mentioned in the first embodiment are all marked with the same symbols and are not repeated here again.

In FIG. 3A, the linkage mechanism 2—2 comprises a block 2*a'*, a portion 2*b'*, a portion 2*c'*, a portion 2*d'* and a slot 21, wherein the block 2*a'* is guided by the slot 21 and moved back and forth along the path of the slot 21. The block 2*a'* is connected to the portion 2*c'* with hinge X3, the portion 2*b'* is an oscillating arm mounted on the first surface 10 with hinge X2, and the portion 2*c'* and the portion 2*b'* are connected to each other with hinge X4. The portion 2*c'* is used as a pallet for supporting the media S and moves between the initial site I and the predetermined site II in parallel. The recovery device 3 is disposed between the portion 2*c'* and the first surface 10, and one end of the recovery device 3 is pressed against the portion 2*c'*.

Once the media S is added or gradually transmitted to the printing device F' by the scrubber 4, the portion 2*c'* of the linkage mechanism 2—2 is downwardly or upwardly shifted by the pressure of the compressed recovery device 3.

Third Embodiment

Figure 4:
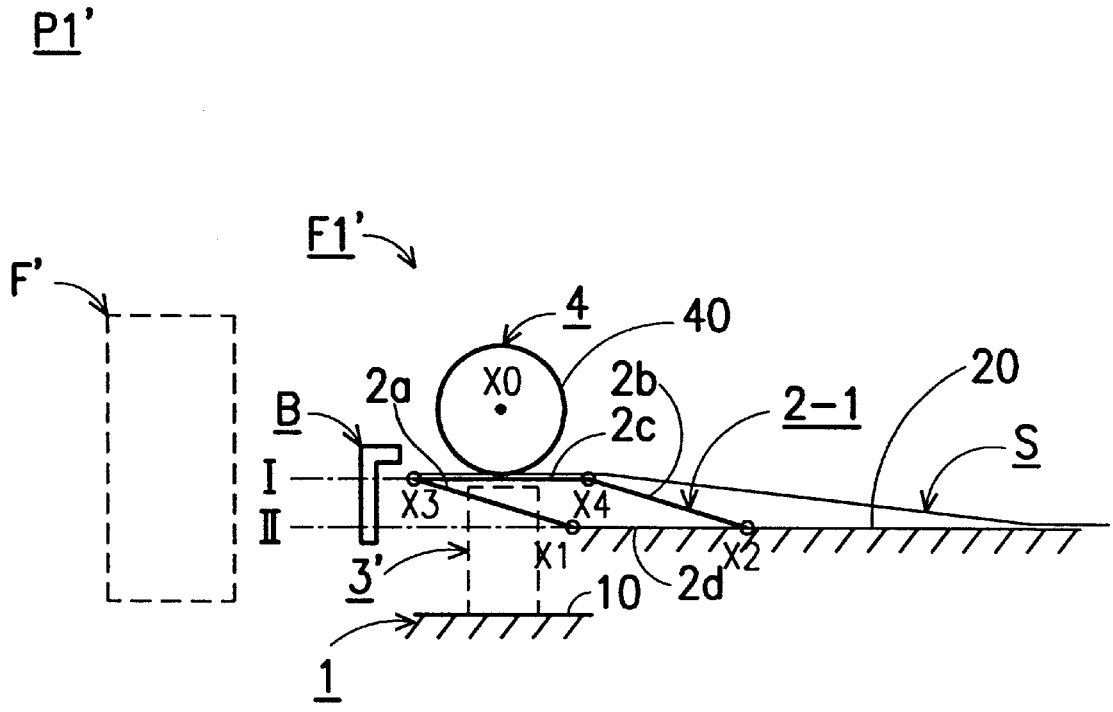
FIG. 4 is a plan view showing a feeding device (F1') of a printer (P1') according to a third embodiment of the present invention.

FIG. 4 is a plan view showing the feeding device F1' of a printer P1' according to a third embodiment of the present invention.

The feeding device F1' differs from the feeding device F1 of the first embodiment in that the recovery device 3 is only replaced with a recovery device 3', applied by a magnetic device. The magnetic forces generated from the recovery device 3' also can precisely control the movement of the third portion 2*c* of the linkage mechanism 2-1 between the initial site I and the predetermined site II.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A feeding device for transmitting media, comprising:

a substrate;

a four-portion linkage mechanism disposed on the substrate, having a pallet used to support the media and move between an initial site and a predetermined site in parallel to the initial site; and a scrubber for feeding the media located on the pallet, wherein the linkage mechanism further comprises a first portion, a second portion and a third portion, wherein the pallet is fixedly attached to the first portion and the second portion, and the third portion is fixedly attached to the first portion and the second portion.

2. The feeding device as claimed in claim 1 further comprising a recovery device disposed on the linkage mechanism.

3. The feeding device as claimed in claim 2, wherein the recovery device is a resilient device.

4. The feeding device as claimed in claim 2, wherein the recovery device is a spring.

5. The feeding device as claimed in claim 2, wherein the recovery device is a magnetic device.

6. The feeding device as claimed in claim 1 further comprising a recovery device disposed between the substrate and the pallet of the linkage mechanism.

7. The feeding device as claimed in claim 6, wherein the recovery device is a resilient device.

8. The feeding device as claimed in claim 6, wherein the recovery device is a spring.

9. The feeding device as claimed in claim 6, wherein the recovery device is a magnetic device.

10. The feeding device as claimed in claim 6, wherein the linkage mechanism further comprises a first portion, a second portion and a third portion, wherein the first portion and the second portion are two oscillating arms with the same size, which are mounted on the substrate, and the pallet is connected to both the first portion and the second portion.

11. The feeding device as claimed in claim 6, wherein the linkage mechanism further comprises a block, a portion and a slot, wherein the block is guided by the slot and moved back and forth along the path of the slot, the block is connected to pallet, the pallet and the portion are connected to each other, and the portion is an oscillating arm mounted on the substrate.

12. The feeding device as claimed in claim 1, wherein the linkage mechanism comprises a block disposed on the substrate.

13. A feeding device for transmitting media, comprising:

a substrate;

a four-portion linkage mechanism disposed on the substrate, having a pallet used to support the media and move between an initial site and a predetermined site in parallel to the initial site;

a deskewer for deskewing the media located on the pallet;

a recovery device disposed on the linkage mechanism; and a scrubber for feeding the media located on the pallet.

14. The feeding device as claimed in claim 13, wherein the linkage mechanism comprises a block disposed on the substrate.

15. The feeding device as claimed in claim 13, wherein the recovery device is a resilient device.

16. The feeding device as claimed in claim 13, wherein the recovery device is a spring.

17. The feeding device as claimed in claim 13, wherein the recovery device is a magnetic device.

18. A printer for printing media, comprising:

a feeding device having a substrate, a four-portion linkage mechanism disposed on the substrate and having a pallet used to support the media and moving between an initial site and a predetermined site in parallel to the initial site, a deskewer for deskewing the media located on the pallet, a recovery device disposed on the linkage mechanism, a scrubber for feeding the media located on the pallet; and a printing device for printing the media transmitted from the feeding device.

19. The printer as claimed in claim 18, wherein the recovery device is a resilient device.

20. A feeding device for transmitting media, comprising:

a substrate;

a four-portion linkage mechanism disposed on the substrate, having a pallet used to support the media and move between an initial site and a predetermined site in parallel to the initial site; and a scrubber for feeding the media located on the pallet, wherein the linkage mechanism further comprises a first portion, a second portion and a third portion, wherein the first portion, the second portion, the third portion and the pallet are all straight.

21. The feeding device as claimed in claim 20 further comprising a recovery device disposed on the linkage mechanism.

22. The feeding device as claimed in claim 21, wherein the recovery device is a resilient device.

23. The feeding device as claimed in claim 21, wherein the recovery device is a spring.

24. The feeding device as claimed in claim 21, wherein the recovery device is a magnetic device.

25. The feeding device as claimed in claim 20 further comprising a recovery device disposed between the substrate and the pallet of the linkage mechanism.

26. The feeding device as claimed in claim 25, wherein the recovery device is a resilient device.

27. The feeding device as claimed in claim 25, wherein the recovery device is a spring.

28. The feeding device as claimed in claim 25, wherein the recovery device is a magnetic device.

29. The feeding device as claimed in claim 25, wherein the linkage mechanism further comprises a first portion, a second portion and a third portion, wherein the first portion and the second portion are two oscillating arms with the same size, which are mounted on the substrate, and the pallet is connected to both the first portion and the second portion.

30. The feeding device as claimed in claim 25, wherein the linkage mechanism further comprises a block, a portion and a slot, wherein the block is guided by the slot and moved back and forth along the path of the slot, the block is connected to pallet, the pallet and the portion are connected to each other, and the portion is an oscillating arm mounted on the substrate.

31. The feeding device as claimed in claim 20, wherein the linkage mechanism comprises a block disposed on the substrate.

32. A feeding device for transmitting media, comprising:

a substrate;

a four-portion linkage mechanism disposed on the substrate, having a pallet used to support the media and move between an initial site and a predetermined site in parallel to the initial site;

a scrubber for feeding the media located on the pallet; and a recovery device disposed on the linkage mechanism, wherein the recovery device is a magnetic device.

33. A feeding device for transmitting media, comprising:

a substrate;

a four-portion linkage mechanism disposed on the substrate, having a pallet used to support the media and move between an initial site and a predetermined site in parallel to the initial site;

a scrubber for feeding the media located on the pallet; and a recovery device disposed between the substrate and the pallet of the linkage mechanism, wherein the linkage mechanism further comprises a block, a portion and a slot, wherein the block is guided by the slot and moved back and forth along the path of the slot, the block is connected to pallet, the pallet and the portion are connected to each other, and the portion is an oscillating arm mounted on the substrate.

* * * * *